US005522301A

United States Patent [19]

Roth et al.

[11] Patent Number: 5,522,301

[45] Date of Patent: Jun. 4, 1996

[54] PRESSURE CONTROL VALVE FOR A HYDRAULIC ACTUATOR

[75] Inventors: James E. Roth; Raymond D. Atchley, both of Los Angeles; Ori D. Chen-Zion, Woodland Hills; John B. Pegram, Los Angeles; Maurice E. P. Gunderson, Orinda, all of Calif.

[73] Assignee: E–Systems, Inc., Dallas, Tex.

[21] Appl. No.: 198,190

[22] Filed: Feb. 17, 1994

Related U.S. Application Data

[63] Continuation-in-part of Ser. No. 969,130, Oct. 30, 1992, abandoned.

[51] Int. Cl.[6] ..... F15B 13/043

[52] U.S. Cl. ..... 91/433; 91/461; 91/463; 91/465; 137/83; 137/596.15; 137/596.16; 137/596.18

[58] Field of Search ..... 91/433, 461, 463, 91/465; 137/83, 596.15, 596.16, 596.18

[56] References Cited

U.S. PATENT DOCUMENTS

| | | | |
|---|---|---|---|
| 825,998 | 7/1906 | Wilkinson | 137/55 |
| 2,742,919 | 4/1956 | Ray | 137/330 |
| 2,771,061 | 11/1956 | Farron . | |
| 2,832,318 | 4/1958 | Paine | 137/85 X |
| 2,880,708 | 4/1959 | Hayner . | |
| 2,990,839 | 7/1961 | Ray | 137/83 X |
| 3,055,346 | 9/1962 | Hardesty et al. . | |
| 3,095,906 | 7/1963 | Kolm, Jr. | 137/625.62 |
| 3,228,423 | 1/1966 | Moog, Jr. | 137/625.62 |
| 3,398,650 | 8/1968 | Garnjost | 91/421 |
| 3,528,446 | 9/1970 | Horn | 137/625.63 X |
| 3,542,051 | 11/1970 | McFadden et al. | 137/83 |
| 3,556,144 | 1/1971 | Bickers . | |
| 3,580,281 | 5/1971 | Petersen . | |
| 3,612,103 | 10/1971 | Waddington | 137/625.63 |
| 3,752,189 | 8/1973 | Marr et al. | 137/625.65 |
| 3,759,145 | 9/1973 | Taylor | 91/459 |
| 4,017,706 | 4/1977 | Aubrecht et al. | 219/69 M |
| 4,061,155 | 12/1977 | Sopha . | |
| 4,123,964 | 11/1978 | Strauff | 91/434 |
| 4,161,136 | 7/1979 | Krieger | 91/461 |
| 4,337,797 | 7/1982 | Caruso | 137/625.48 |
| 4,338,965 | 7/1982 | Garnjost et al. | 137/554 |
| 4,444,090 | 4/1984 | Joelson | 91/363 R |
| 4,523,513 | 6/1985 | Gudat et al. | 91/427 |
| 4,537,220 | 8/1985 | Anderson | 137/596.14 X |
| 4,616,674 | 10/1986 | Bardoll . | |
| 4,619,187 | 10/1986 | Blake et al. | 91/523 |
| 4,664,135 | 5/1987 | Hayner | 137/82 |
| 4,805,515 | 2/1989 | Kast . | |
| 4,827,981 | 5/1989 | Livecchi et al. | 137/625.69 |
| 4,942,344 | 7/1990 | Devitt et al. | 318/254 |
| 5,015,000 | 5/1991 | Perini | 277/16 |
| 5,027,858 | 7/1991 | Gold . | |
| 5,031,663 | 7/1991 | Fukuta et al. . | |
| 5,058,484 | 10/1991 | Kuttruf | 91/461 |
| 5,088,383 | 2/1992 | Wardle et al. . | |
| 5,099,875 | 3/1992 | Smietana | 137/504 |

OTHER PUBLICATIONS

Unity Pressure Ratio Valve E066 Series, flyer Moog Controls Limited, Ashchurch, Tewkesbury, Glos. (Undated).

Dynatest series of actuators brochure, Kelsey Instruments, Limited (Undated).

*Primary Examiner*—Gerald A. Michalsky

*Attorney, Agent, or Firm*—Pretty, Schroeder, Brueggemann & Clark

[57] ABSTRACT

A two stage valve assembly responsive to signals from a control system for supplying pressurized fluid to two load lines. The first stage includes a motor that directs pressurized fluid from a jet pipe toward a receiver assembly having two receiver ports and a bleedoff area disposed between and separating the receiver ports. The second stage assembly includes two spool/sleeve assemblies that control the flow of pressurized fluid to and from the two load lines. A drain line from the receiver assembly includes a pressure relief valve, which insures that both spool/sleeve assemblies will be servo-controlled at all times. Cartridges may be inserted in the spool/sleeve assemblies to linearize the relationship between input current from the control system and the output force of an unequal area actuator connected to the load lines.

27 Claims, 4 Drawing Sheets

PRESSURE CONTROL VALVE FOR A HYDRAULIC ACTUATOR

This application is a continuation-in-part of application Ser. No. 07/969,130 filed Oct. 30, 1992 now abandoned.

FIELD OF THE INVENTION

This invention relates generally to devices for operating piston-type hydraulic actuators, rotary hydraulic actuators or hydraulic motors and, more particularly, to a pressure control valve having a first stage jet pipe/receiver assembly and a second stage dual spool/sleeve assembly.

BACKGROUND OF THE INVENTION

Piston-type hydraulic actuators are used in numerous structural and material testing applications. For example, such actuators are used in the aerospace and automotive industries to test structural parts for fatigue. Additionally, these actuators may be used for aircraft braking systems, flight control systems, flight simulation systems or force control systems for industrial process equipment. A typical actuator of this type includes a movable fluid driven piston inside a cylinder having an actuator chamber on each side of the piston for moving the piston in opposite directions when pressurized fluid is supplied to one of the chambers.

In many applications, it is necessary that the actuator be controlled to apply a force to a structural part as a function of time, such as through a fatigue loading cycle. One system used for controlling the movement of an actuator is a flow control valve that includes a torque motor having a pivotable armature, a jet-pipe/receiver assembly (first stage) having a jet pipe connected to the armature and a pair of receivers, and a single four-way sliding spool valve (second stage) having a spool that controls two ports, one to each of the actuator chambers. Hydraulic fluid at system pressure is fed to a jet pipe nozzle that directs a fine jet stream of fluid at the two receivers. Each receiver is connected to a corresponding end of the second stage spool. At null (no signal to the torque motor), the jet stream impinges equally on each receiver and equal recovery pressure (approximately one-half system pressure) is generated in each. Thus, the forces at each end of the second stage spool are equal and it remains in the null position. When an electrical input signal is applied to the torque motor, it causes the armature and the jet-pipe to rotate about the armature pivot point, causing more fluid to impinge on one receiver than the other. The resulting differential pressure at the ends of the spool causes the spool to move, which opens the second stage ports, causing fluid to flow to one actuator chamber and out of the other actuator chamber. A feedback spring between the jet-pipe and the spool is used to counteract the force applied to the jet-pipe by the torque motor and stabilizes the spool in its new position.

One problem with flow control valves of this type is that they have an inherently high pressure gain or amplification, e.g., at about 3% of rated valve input current, approximately 90% of system pressure is obtained. Thus, if a structural test requires a maximum pressure level of 1% of system pressure, then the system must control down to 0.03% of rated current to obtain this pressure setting. This fine resolution of control is difficult to achieve with flow control valves given the present accuracy of the valves, transducers and control electronics. High gain also results in an abrupt transition or backlash of the piston when it reverses directions, possibly affecting the stability of the mechanical joints in the system being tested.

Flow control valves also have further disadvantages. Zero slack side pressure (i.e., zero pressure on the low pressure side of the actuator) cannot be achieved, and therefore, to obtain a given force on the structural part being tested, the actuator piston must overcome the slack side pressure, giving a load error to the control system. Because of slack side pressurization, complex abort manifolds incorporating expensive, specially designed, differential load limiters are required to provide a safety outlet in the event of overpressurization or other malfunction. Flow control valves also require load sensor feedback loops which result in channel crosstalk in large installations using many flow control valves.

Another system used for controlling the movement of an actuator is a pair of valves, one connected to each side of the actuator. Each valve has a torque motor, a nozzle/flapper receiver assembly (first stage) and a three-way sliding spool (second stage). Typically, one valve is energized at a time, pressurizing only one side of the actuator at a time. The system therefore does not have the disadvantages of the flow control valve, such as slack side pressurization. However, the dual valve system tends to be more expensive and to have greater maintenance requirements because it requires two torque motors and two nozzle/flapper receiver assemblies. The system also has the potential to pressurize both sides of the actuator at the same time if one valve fails. Furthermore, the nozzle/flapper receiver assembly is not as contamination tolerant as the jet-pipe type of assembly.

Another problem encountered with piston-type hydraulic actuators in general is the handling of unequal area actuators. Typically, a single piston rod is mounted at one end to the piston and at its other end to the structural load being tested. Because the piston rod is on one side only, the opposite faces of the piston have unequal areas being exposed to the pressurized fluid. The force transmitted by the piston is equal to the pressure in the actuator cylinder multiplied by the area of the piston face. Thus, the pressure applied to one side of the actuator will result in a different magnitude of force applied to the load than if the same pressure is applied to the other side of the cylinder. It is desirable that the force applied by the piston be the same and proportional to the control current applied to the valve, regardless of the direction of piston movement. Present methods of achieving this, however, involve the use of complex control electronics that are not easily corrected should it become necessary to make changes to the actuator in the field.

From the above, it should be appreciated that there is a need for a less complex hydraulic control system that smoothly controls the pressure applied to each side of the actuator and the movement of the actuator itself. Ideally, such a system would also correct the problem associated with unequal area actuators such that the piston force applied to the structure is generally proportional to the control current applied by the control system. The present invention provides the necessary solution.

SUMMARY OF THE INVENTION

The present invention relates to an improved pressure control valve for a piston-type hydraulic actuator that provides force output as a function of input current in a substantially linear, straight-line relationship. The valve includes a new jet pipe/receiver assembly having a jet pipe for directing a stream of pressurized fluid, a torque motor responsive to signals from a control system for imparting movement to the jet pipe and a receiver assembly having two spaced-apart ports located in a receiver chamber for selectively receiving the stream of pressurized fluid. The control current to the torque motor directs the stream of pressurized fluid to one of the two receiver ports which conducts the hydraulic pressure to a first spool/sleeve assembly. Reversing the control current to the torque motor directs the stream of pressurized fluid to the other of the two receiver ports, conducting the hydraulic pressure to a second spool/sleeve assembly. When the stream of pressurized fluid from the jet pipe is supplied to one of the spools, that spool moves to permit fluid under system pressure to flow to a respective side of the actuator.

A feature of the pressure control valve of the present invention is the separation of the receiver ports, preferably by the diameter of the stream issuing from the jet-pipe, and the bleeding of the stream of pressurized fluid between the ports to a return area so that at null (no signal to the torque motor), only a relatively low pressure (based on the level at which the receiver chamber pressure is set) is developed in the receiver ports. This arrangement of receiver ports has a significant advantage over prior art receivers (wherein each receiver port receives one-half of supply pressure at null), because it permits a relatively low gain at null and individual receiver pressurization by the jet pipe, and thus a smoother transition of control from one spool to the other spool and back again. Correspondingly, there is a smooth transition of pressure from one side of the actuator to the other side. This enhances system stability on mechanical joints by reducing backlash or turnaround "bump" when reversing forces.

This arrangement of receiver ports also ensures that only one spool is activated by jet pipe pressurization at a time. Accordingly, during operation, only one side of the actuator piston is pressurized while the other side of the actuator piston (the slack side) is at return pressure, zero pressure or is servo-controlled at a relatively low pressure. Therefore, load pressure is primarily a function only of the loaded side of the actuator, reducing the overall load error of the system and improving the system load control accuracy. There is no need for expensive differential safety relief valves. Poppet or sleeve relief valves that dump to return when the maximum pressure setpoint is exceeded may be used. This greatly increases reliability and reduces maintenance associated with installation setup and repair.

In a preferred embodiment, separate pilot pressure supply and return lines are connected to the jet pipe/receiver assembly. A drain line connects the receiver chamber to the pilot pressure return line and a pressure relief valve is placed in the drain line to maintain a relatively low pressure, e.g., 100 psi, in the receiver chamber. This results in a constant input pressure to the slack side receiver (i.e., the receiver not pressurized by the jet pipe), which, in turn, results in the slack side of the actuator being servo-controlled to the receiver chamber pressure. An advantage of receiver chamber pressurization is that the slack side spool is also servo-controlled and, will therefore, react immediately during crossover (i.e., the transition of pressure from one side of the actuator to the other), further enhancing system stability and smooth operation. It is preferred that the pilot pressure lines be isolated from the main system pressure lines to prevent fluctuations of system pressure from affecting the receiver chamber pressure.

The pressure control valve of the present invention exhibits a substantially linear relationship between input current and load pressure output to the actuator. The jet-pipe has a separate hydraulic supply and pressure from it is available from 0 to 80 percent, by each receiver to control the second stage spool. Above 80 percent, however, the relationship becomes gradually nonlinear. Accordingly, an important feature of the present invention is the use of a cartridge that increases linearity up to substantially 100 percent of load pressure output. This cartridge is axially positioned with respect to one or both of the spool/sleeve assemblies and adjacent the location where pressurized fluid is supplied. The cartridge acts as a hydraulic amplifier for the receiver pressure, increasing the pressure to the actuator to 100% of system pressure when only 80% of supply pressure is recovered by the jet-pipe/receiver assembly, thus substantially linearizing the valve from approximately 0 to 100 percent of the pressure control range when working in an open loop control mode.

A field replaceable cartridge may be used to compensate for unequal area actuators. Such a cartridge may be installed adjacent one of the spool/sleeve assemblies to increase or decrease the magnitude of the maximum output force on one side of the actuator to equal the magnitude of the maximum force available on the other side of the actuator. The result is a proportional force output from the actuator as a function of current input. In other words, a substantially linear relationship is established between actuator force and current input.

Further significant benefits are derived when a separate pilot pressure supply and return is used with multiple control valves made according to the present invention. For example, in the event of system shut-down or an actuator failure, a valve may be controlled by either gradually reducing the input current to all valves or by maintaining input current levels and reducing the pilot stage supply pressure to all valves. Lowering the pilot supply pressure will lower the delivered cylinder pressure in a controlled manner. This, when done on the pilot supply of all valves in the system, will allow a controlled, gradual shut-down of the system and all actuators will reduce load pressure in conjunction with each other in a simultaneous, controlled manner without damage to the system or the structure being tested. Thus, the load may be adjusted by controlling either of two parameters, input current or pilot supply pressure. This feature improves the failsafe characteristics of the invention to protect the test specimen. The use of a separate pilot supply and return also helps eliminate cross-talk (i.e., pulses in the line) between actuators and valves due to pressure fluctuations during system operation. Any interaction between several actuator channels would create load errors.

The present invention may be further modified to provide other benefits and advantages. Each spool/sleeve assembly may be provided with a single pressure land which allows fluid into the actuator and two or more return lands to reduce the outgoing actuator pressure to a minimum, reducing load errors to the system. A low force, spool spring may also be incorporated to ensure that when pilot supply pressure is of the spool position will open to return pressure. This ensures that the actuator will not be hydraulically locked and the load can be manually moved by hand without the need for removing hydraulic lines or hoses.

Passageways, including feedback passageways, may be included in each spool/sleeve assembly to counteract the first stage receiver force applied to the spools and thus control spool metering. Damping orifices are included to maintain damping and stability.

Velocity limiting spool stops may be used to limit the maximum spool stroke and thus actuator velocity. The stops are independently set for each side of the actuator to accurately set extend or retract velocities.

Pressure transducers may be used to monitor and provide feedback signals to the control electronics. Each transducer may be installed in a port that measures control pressure from each first stage receiver with the loop closed around the pressure from each receiver. This reduces hysteresis and improves linearity by a factor of unity divided by the loop gain (a factor of ten for example). The second stage spool operates in open loop fashion.

The valve may be mounted on an integral abort manifold that employs customized abort capability such as load limit relief valves.

Other features and advantages of the present invention will become apparent from the following description of the preferred embodiment, taken in conjunction with the accompanying drawings, which illustrate, by way of example, the principles of the invention.

DETAILED DESCRIPTION OF THE PREFERRED EMBODIMENT

Figures 1, 6:
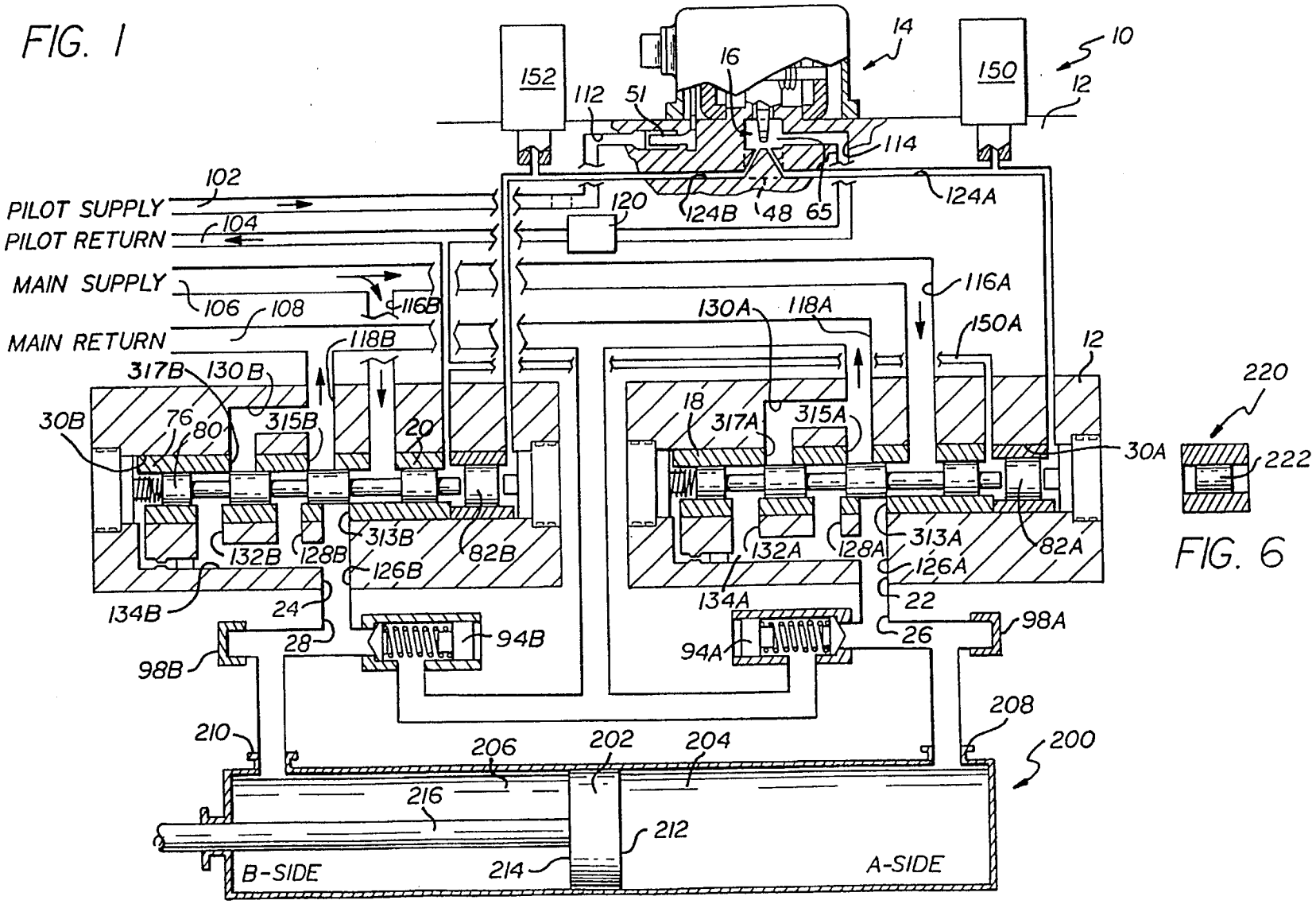
FIG. 1 is a schematic of a pressure control valve made according to the present invention connected to an actuator.
FIG. 6 is an area-ratio cartridge having a smaller diameter spool that may be used with the present invention.

A pressure control valve 10 embodying the features of the present invention is shown schematically in FIG. 1. The valve includes a valve body 12 having hydraulic porting and passageways to provide hydraulic flow and pressure to key subassemblies, a torque motor assembly 14 that is responsive to electrical input signals from a control system (not shown) and a jet-pipe/receiver assembly 16 that takes pressurized fluid and directs it to one or the other of first and second spool/sleeve assemblies 18, 20.

The valve may be used with a piston-type hydraulic actuator 200 having a movable fluid driven member or piston 202 and first and second actuator chambers 204, 206 for moving the piston in opposite directions when pressurized fluid is supplied to one of the chambers. The first actuator chamber 204, sometimes referred to herein as the A-side, has a port 208 for permitting pressurized fluid to flow into or out of the first actuator chamber. The second actuator chamber 206, sometimes referred to herein as the B-side, has a port 210 for permitting pressurized fluid to flow into or out of the second actuator chamber.

The piston has first and second faces 212, 214, forming one side of the first and second actuator chambers, respectively. A single piston rod 216 is connected at one of its ends to the second face of the piston, extends through and out of the second actuator chamber and is mounted at its other end to a workpiece (not shown) to be loaded or tested. When pressurized fluid is supplied to the first actuator chamber 204, the piston will tend to move to the left, extending the piston rod. When pressurized fluid is supplied to the second actuator chamber 206, the piston will tend to move to the right, retracting the piston rod. Due to the connection of the piston rod to the second face of the piston, the exposed surface area of the second face is less than the exposed surface area of the first face, making this an unequal area actuator.

The valve 10 also has an A-side and a B-side. The A-side of the valve communicates with the A-side of the actuator via a valve port. 22 in the valve body and a first load line 26 extending from the valve port 22 to the first port 208 of the first actuator chamber. The B-side of the valve communicates with the B-side of the actuator via a valve port 24 in the valve body and a second load line 28 extending from the valve port 24 to the second port 210 of the second actuator chamber.

In the preferred embodiment, a pilot supply pressure line 102, a pilot return pressure line 104, a main supply pressure line 106 and a main return pressure line 108 are separately provided to and from the pressure control valve. The pilot supply and return lines communicate with the jet-pipe/receiver assembly 16 through a jet pipe supply passageway 112 and a drain passageway 114, respectively. The main supply line 106 communicates with the first and second spool/sleeve assemblies 18, 20 through passageways 116A and 116B, respectively, and the main return line 108 communicates with the first and second spool/sleeve assemblies through passageways 118A and 118B, respectively. Auxiliary passageways 130A, 130B, to increase return flow, may also be provided.

Supply passageways 126A, B are provided in the valve body to permit flow between the first load line 26 and the first spool/sleeve assembly 18 and between the second load line 28 and the second spool/sleeve assembly 20, respectively. Bypass passageways 134A, B, including feedback passageways 136A, B, are connected between the spool/sleeve assemblies and the supply passageways 126A, B to provide for spool control and return flow. Similarly, return flow passageways 128A, B connect the spool/sleeve assemblies to the bypass passageways 134A, B. Auxiliary return flow passageways 132A, B may be used to quickly reduce outgoing actuator pressure.

Figure 2:
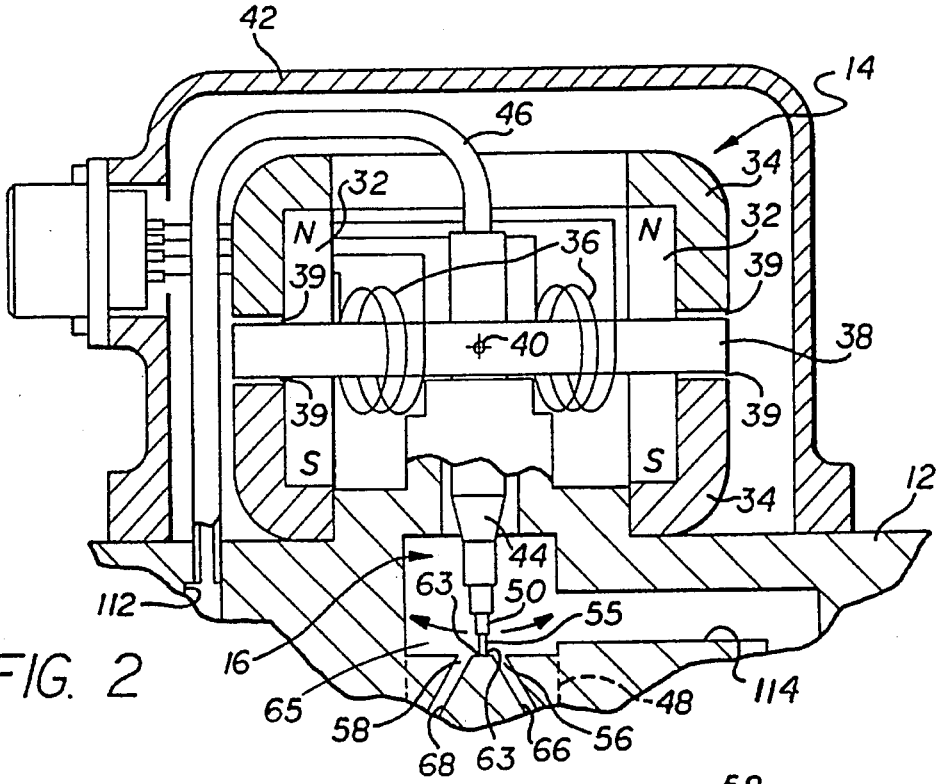
FIG. 2 is an enlarged schematic view of the torque motor assembly and the jet-pipe/receiver assembly shown in FIG. 1.

With reference to FIG. 2, the torque motor assembly 14 is shown mounted to the valve body 12. Torque motors are well known by persons skilled in the art and need not be fully described herein. Briefly, the torque motor assembly typically includes permanent magnets 32, pole pieces 34 that carry the magnetic flux from the magnets, coils 36 and an armature 38 that rotates through a small angle between the pole pieces. There is an air gap 39 between each end of the armature and each pole piece. The armature is supported at its centerpoint 40 by a friction-free flexure bearing (not shown). The coils are electrically wired to the control system. Thus, a suitable electrical control signal (i.e., an input current) may be supplied to the coils of the torque motor assembly to cause the armature to move substantially pivotably about its center point 40. The force acting on the armature is proportional in magnitude and direction to the corresponding input current. A spring (not shown) may be used to return the armature to its central position when there is no signal applied to the motor. A cover 42 may be mounted over the torque motor assembly and to the valve body to protect the torque motor components. Also, the torque motor assembly may be sealed to isolate its components from the pressurized fluid entering the valve body.

The jet-pipe/receiver assembly 16 includes a jet-pipe 44, a jet-pipe supply line 46 and a receiver module 48. The jet-pipe supply line directs pressurized fluid from the pilot supply line 102 to the jet-pipe. The jet-pipe has a nozzle 50 directing a stream 55 of pressurized fluid out of the jet-pipe into a receiver chamber 65 toward the receiver module 48. An integral, field replaceable, filter assembly 51 may be provided in the jet-pipe supply passageway 112 to protect the jet-pipe from contamination (see FIG. 1).

Figure 3A:
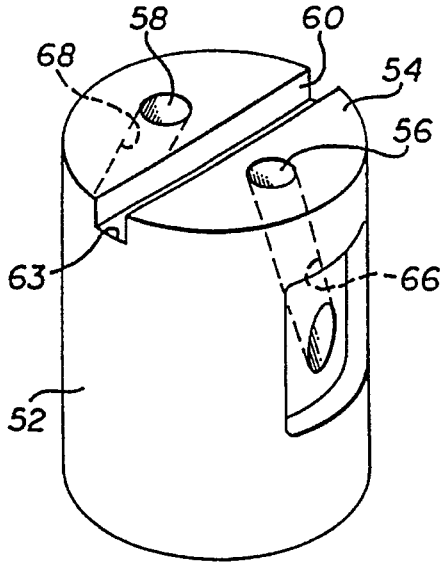
FIGS. 3A and 3B are perspective views of receiver modules that may be used with the present invention.
Figure 3B:
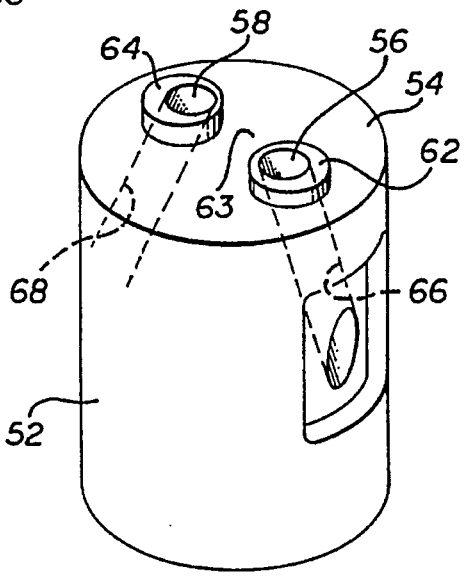

With reference to FIGS. 3A and 3B, the receiver module 48 is preferably a cylindrical member 52 mounted in the valve body. As shown in FIG. 3A, the cylindrical member has an upper face 54 with first and second orifices or ports 56, 58 that are separated by a diametral slot 60. Alternatively, as shown in FIG. 3B, the upper face of the cylindrical member may be provided with a pair of upwardly extending posts 62, 64, with the first orifice located in one of the posts and the second orifice located in the other post. In either case, a bleedoff area 63 between the orifices is connected to the drain passageway 114 (see FIGS. 1 and 2) to direct excess fluid to the pilot return line 104. Additional passageways 124A, B are provided in the valve body 12 to permit pressurized fluid to flow from the receiver module to the first and second spool/sleeve assemblies 18, 20, respectively. The cylindrical member 52 defines a first passage 66 connecting the first orifice 56 to passageway 124A and a second passage 68 connecting the second orifice 58 to passageway 124B.

In the preferred embodiment, the drain passageway 114 is provided with a pressure relief valve 120 that maintains the pressure in the receiver chamber 65 at a predetermined minimum, e.g., 100 psi, during operation of the valve assembly. Hence, a minimum pressure will always be maintained in passageways 124A, 124B between the receiver module and the first and second spool/sleeve assemblies, respectively, during operation of the valve. As will be described later, this results in both spools being continuously servo-controlled.

The torque motor assembly and the jet-pipe/receiver assembly form a first stage of the pressure control valve. In the preferred embodiment, the jet-pipe 44 is mounted to the center of the armature 38 of the torque motor assembly and the receiver module 48 is seated within the valve body such that when no electrical signal (i.e., a null signal) is applied to the torque motor coils, the jet-pipe nozzle will direct a stream of pressurized fluid to the bleedoff area 63 between the two orifices 56, 58 of the receiver module 48.

This first stage design results in a pressure reading at the receiver orifices of well below half of supply pressure at null. This may be obtained by separating the receiver orifices by approximately one jet nozzle diameter and bleeding flow at null to the drain so that, at null, only a relatively low pressure (based on the level at which the receiver chamber pressure is set) is developed at the orifices. Hence, minimal flow and pressure will be developed in passageway 124A between the receiver module and the first spool/sleeve assembly 18 and in passageway 124B between tile receiver module and the second spool/sleeve assembly 20.

Applying an input signal from the control system to the coils of the torque motor causes the armature and jet-pipe to pivot in one direction, directing pressurized fluid toward one of the receiver orifices, which, in turn, directs flow and pressure to one of the spool/sleeve assemblies. Reversing the input signal to the coils causes the jet-pipe to pivot in the other direction, directing pressurized fluid toward the other receiver orifice which, in turn, directs flow and pressure to the other spool/sleeve assembly. Thus, it is seen that the pressure and flow of pressurized fluid to the spool/sleeve assemblies is controlled near the zero point as opposed to the 50 percent point in some of the prior art systems.

The spool/sleeve assemblies are the major components of a second stage of the pressure control valve of the present invention. The first spool/sleeve assembly is located in the A-side of the valve body and the second spool/sleeve assembly is located in the B-side of the valve body. The first spool/sleeve assembly includes a sleeve 74 disposed in a first bore 30A extending through the valve body and a spool 78 slidably disposed within the sleeve. Similarly, the second spool/sleeve assembly includes a sleeve 76 disposed in a second bore 30B extending through the valve body and a spool 80 slidably disposed within the sleeve. The spool/sleeve assemblies are in many respects identical. Accordingly, in those respects, only one assembly (the A-side assembly) will be discussed in detail, it being understood that the other assembly (the B-side assembly) is the same.

Figure 4A:
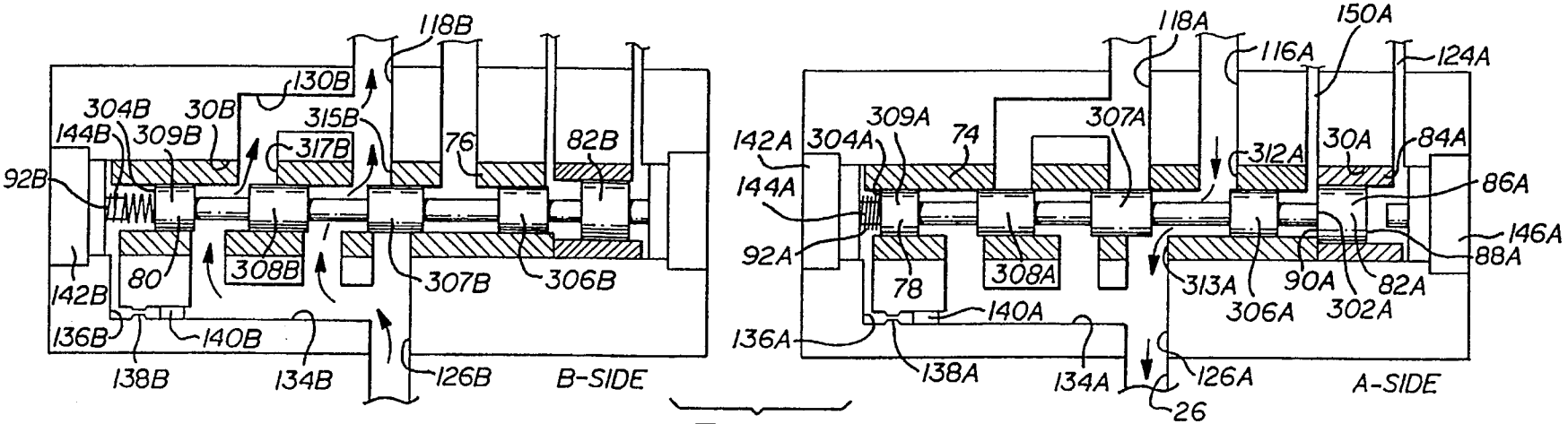
FIGS. 4A and 4B are schematic views of the two spool/sleeve assemblies when pressurized fluid is being supplied to one spool/sleeve assembly or to the other spool/sleeve assembly, respectively.
Figure 4B:
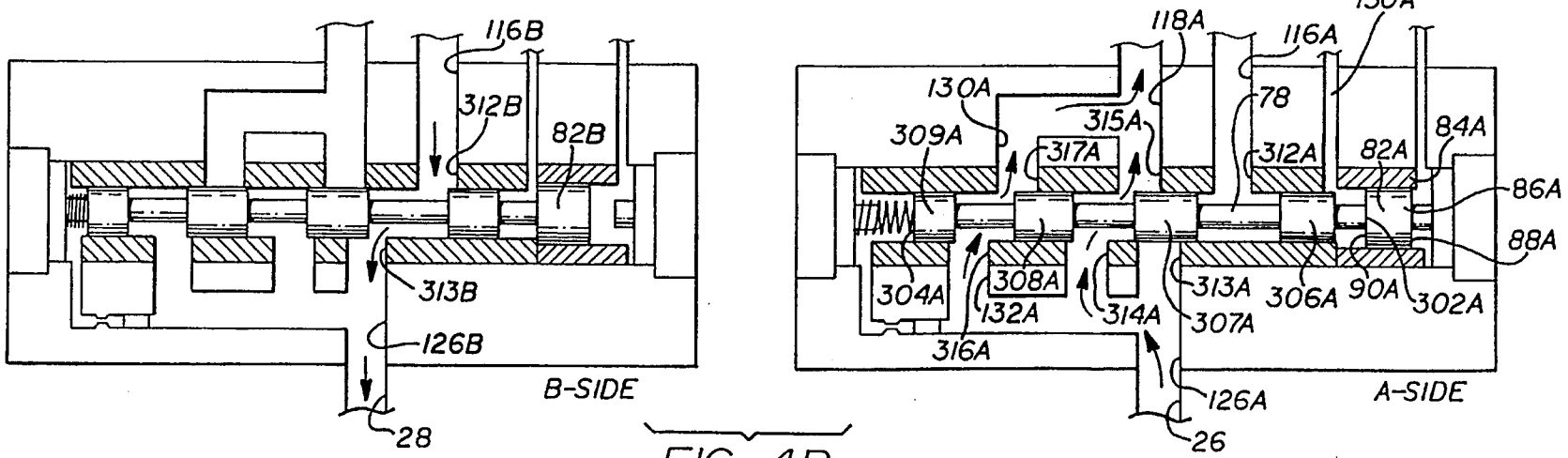

With reference to FIGS. 4A and 4B, the preferred spool 78 has a first end 302A, a second end 304A and four longitudinally spaced lands, a first land 306A, a second land 307A, a third land 308A and a fourth land 309A. The sleeve 74 is provided with ports to permit the flow of pressurized fluid from the main supply line 116A to the first load line 26. In particular, a port 312A (see FIG. 4A) permits pressurized fluid from the main supply passageway 116A into the sleeve between the first and second lands 306A and 307A while a supply port 313A serves as an exit for the pressurized fluid between the first and second lands to supply passageway 126A which communicates with the first load line 26. A port 314A (see FIG. 4B) permits fluid to be expelled from the first actuator chamber into the sleeve between the second and third lands 307A, 308A, while a return port 315A serves as an exit for the fluid between the second and third lands to the main return passage 118A. Auxiliary ports 316A, 317A may be employed between the third land 308A and the fourth land 309A to permit increased return flow from the first actuator chamber through the auxiliary return passageway 132A, through the auxiliary passageway 130A to the main return passageway 118A. The sleeve may be mounted within the bore of the valve body with O-rings (not shown due to schematic nature of the figures) which isolate the sleeve from distortion and which also seal the ports.

In the preferred embodiment, each spool/sleeve assembly has a field replaceable cartridge 82A, 82B that is used to transmit the pressure developed in the first stage of the pressure control valve to the second stage. Two types of cartridges may be used, each having a different function. Each type of cartridge, however, is installed in the bore of the valve body adjacent the first end of the first spool 78 and/or the second spool 80. With respect to the A-side, the bore 30A is capped adjacent the cartridge 82A with a threaded nut 146A. Pressurized fluid from the receiver module through passageway 124A enters the bore between the cartridge and the threaded nut.

The cartridge 82A includes a sleeve portion 84A, preferably having the same outer diameter as the sleeve 74 of the spool/sleeve assembly 18 and a spool portion 86A slidably disposed within the sleeve portion 84A. The spool portion has a first end 88A and a second end 90A, the latter being disposed adjacent the first end 302A of the first spool 78. Due to the force of the pressurized fluid on the spool portion, it moves into engagement with the first end of the spool 78, moving the spool to the left and opening the supply port 313A between the first and second lands, thus supplying pressurized fluid to the first actuator chamber 204.

The force applied by the cartridge 82A to the first end 302A of the spool 78 dictates the force applied to the piston 202 in the first actuator chamber 204. In turn, the force applied to the cartridge is a function of the surface area of the first end 88A of the spool portion 86A and the pressure in the passageway 124A. Accordingly, by increasing (or decreasing) the diameter of the cartridge spool portion, the force applied by the cartridge to the spool, and the force on the piston, increases (or decreases).

Some leakage may occur between the sleeve portion 84A and the spool portion 86A of the cartridge. Thus, the valve body has a passageway 150A that permits fluid between the cartridge and the first land 306A of the spool to flow out of the spool/sleeve assembly to a separate drain line which disconnects the spool/sleeve assembly from pulses in the line, preventing any substantial buildup of fluid pressure between the cartridge and the first land. Alternatively, the passageway 150A may be connected to the pilot return line 104 downstream of the pressure relief valve 120 in the drain passageway 114 (see FIG. 1).

Figure 5A:
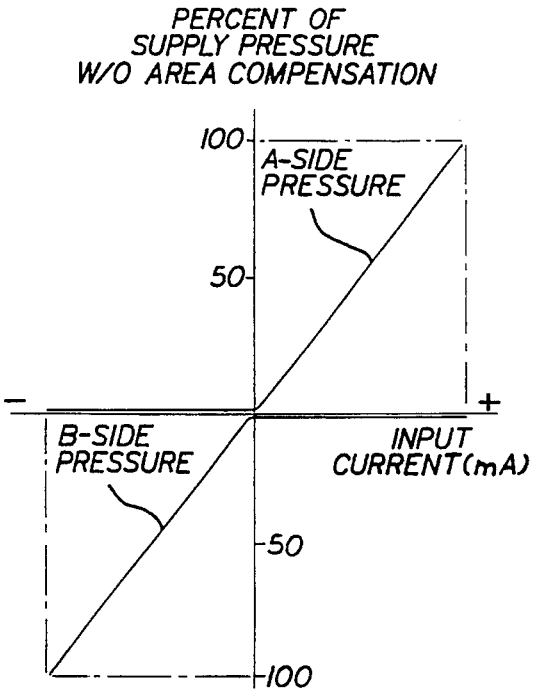
FIGS. 5A and 5B are graphs showing the percentage of maximum supply pressure in the chambers of an unequal area actuator as a function of the input current to the pressure control valve, FIG. 5A indicating output pressure without area compensation and FIG. 5B indicating output pressure with area compensation.
Figure 5B:
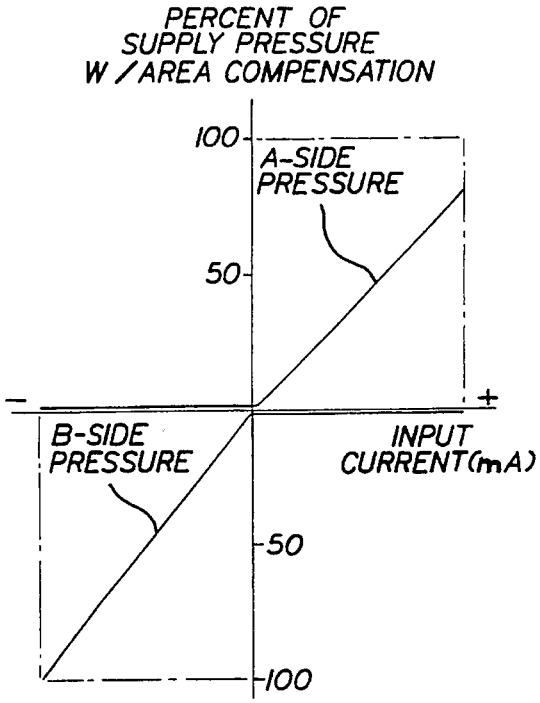
Figure 5C:
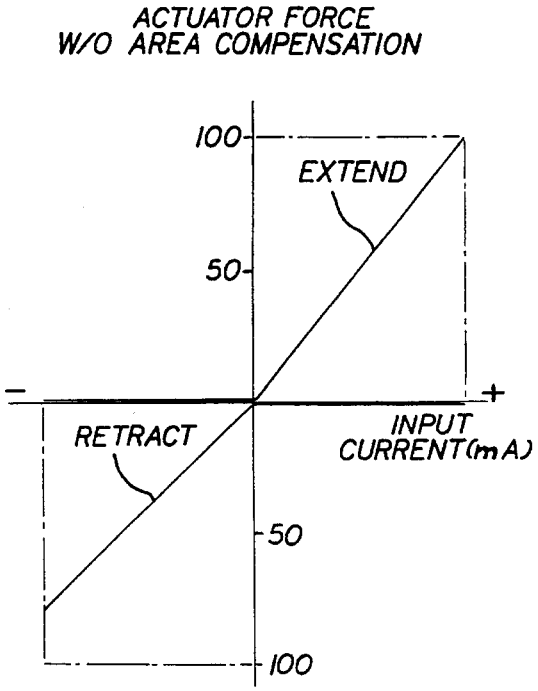
FIGS. 5C and 5D are graphs showing the force output of an unequal area actuator as a function of input current, FIG. 5C indicating output force without area compensation and FIG. 5D indicating output force with area compensation.
Figure 5D:
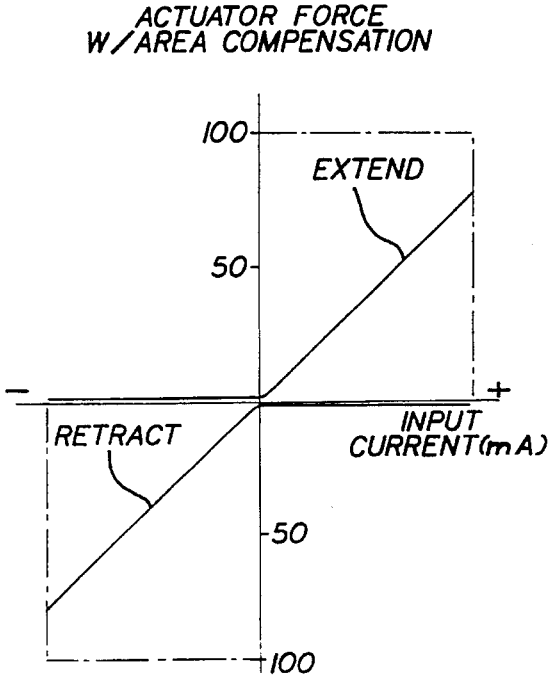

A first type of cartridge may be used to overcome the problem of unequal area actuators. FIGS. 5A and 5B are graphs showing the relationship of chamber pressure as a function of input current for the unequal area actuator shown in FIG. 1. FIGS. 5C and 5D are graphs showing the relationship of force output as a function of input current for the unequal area actuator shown in FIG. 1. Positive current causes pressurized fluid to enter the A-side of the actuator and negative current causes pressurized fluid to enter the B-side of the actuator. FIG. 5A indicates chamber pressure without area compensation. In this case, the pressure in each chamber is the same for the same magnitude current applied to the torque motor. FIG. 5C indicates force output of the piston without area compensation. Notably, for the same magnitude of current, the magnitude of force applied by the actuator is less when the piston is retracting than when it is extending. This is because the B-side of the actuator has the piston rod which reduces the exposed surface area of the piston face. FIGS. 5B and 5D show chamber pressure and output force, respectively, with area compensation. In this case, the pressure in the A-side chamber is reduced as compared to FIG. 5A when input current increases, thus reducing, but linearizing, the force output from the A-side chamber.

To obtain area compensation as shown in FIGS. 5B and 5D, a cartridge 220 as shown in FIG. 6 may be used. In this case, the cartridge has a decreased diameter spool portion 222 and may be inserted into bore 30A on the A-side of the valve body to reduce the force applied to spool 78. Alternatively, a cartridge having an increased diameter spool portion may be inserted into bore 30B on the B-side of the valve body to increase the force applied to spool 80.

A second type of cartridge may be used to compensate for the normal bend-off of pressure that occurs at approximately 80% of maximum supply pressure with a standard jet-pipe pilot valve. To overcome this nonlinearity, the diameter of the spool portion 86A of the cartridge (see FIG. 1) may be increased such that 100% of system supply pressure is applied to the first actuator chamber when only 80% of pilot: supply pressure is applied to the passageway 124A between the first stage and the second stage. A properly-sized cartridge permits the relationship between input current and load pressure output at the actuator to be substantially linear up to 100% of load output. A similar bend-off of pressure occurs as the input current is reduced to zero. This, however, need not be compensated for because the bend-off near zero provides the benefit of reducing backlash and "clunking" when reversing forces. In any event, the pressure relief valve 120 in the drain passageway 114 maintains a predetermined minimum pressure in the actuator chamber, even when the input current is at zero.

It will be appreciated by those skilled in the art that the cartridges may be used in several other ways. For example, the first type of cartridge may be used on the A-side and the second type of cartridge may be used on the B-side or vice versa or a single cartridge combining the features of the first type and second type may be used. It should also be appreciated that the cartridges are easily replaced in the field by simply removing the threaded nuts 146A or 146B. Several appropriately sized cartridges may be made available such that the same pressure control valve may be used with differently sized actuators simply by replacing a cartridge or cartridges.

With reference back to FIGS. 4A and 4B, the first spool/sleeve assembly has a spool control system wherein the feedback passageway 136A and the bypass passageway 134A connect the first load line to the second end 304A of the first spool 78. The feedback passageway has a damping orifice 138A to maintain damping and stability and a filter 140A. The end of the bore 30A adjacent the second end 304A of the spool may be capped by a threaded nut 142A having an inwardly directed, axially adjustable stem 144A that acts as a velocity limiting spool stop. The stem may be adjusted and located within the sleeve to set the maximum stroke of the spool and thus actuator velocity. The stem location may be set independently for the A-side and B-side to accurately set extend or retract velocities of the actuator for the particular application. The stems have no impact on the maximum return flow.

A low force, spool spring 92A may be mounted on the stem 144A to ensure that the spool position will open to return on the slack side when pilot supply pressure is below a predetermined value, e.g. 25 psi. This ensures that when pilot supply pressure is off, the actuator will not be hydraulically locked and the piston rod can be manually moved by hand without the need for removing hydraulic lines or hoses.

The valve may also be mounted on an integral abort manifold having customized abort capabilities such as load limit relief valves 94A, 94B or any other specific components to optimize system performance (see FIG. 1). Test ports 98A, 98B may also be included to simplify initial installation to provide trouble shooting information with the use of pressure transducers or gauges. The limit relief valves may be set by providing an input current signal to the valve torque motor, monitoring gauge or pressure readings, and setting to the required pressure limit.

Pressure transducers 150 and 152 may be connected to each passageway 124A, 124B, respectively, between the first stage and second stage to monitor and provide feedback signals to the control electronics. Pressure transducers may also be connected at the test ports 98A, 98B to measure actuator chamber pressures.

Operation of the above described pressure control valve will now be described. When no signal (FIGS. 1 and 2) is applied to the torque motor assembly 14, the jet-pipe 44 will direct the stream 55 of pressurized fluid from the pilot supply line 102 to the bleedoff area 63 between the two orifices 56, 58 of the receiver module 48. The bleedoff area is connected to the drain passageway 114 which returns the fluid to the pilot return line 104. If the receiver chamber 65 is not otherwise pressurized, no significant pressure is transmitted to the passageways 124A, 124B and therefore the cartridges 82A, 82B do not apply sufficient force to the spools 78, 80 to cause them to open the supply ports 313A, 313B to either side of the actuator.

In the preferred embodiment, however, the receiver chamber is pressurized due to the pressure relief valve 120 in the drain passageway 114. This pressure is transmitted to the passageways 124A, 124B. With regard to the A-side, pressurized fluid will eventually build up in the first bore 30A between the threaded nut 146A and the cartridge 82A, causing the spool portion 86A of the cartridge to apply a force to the first end 302A of the first spool 78 which in turn causes the first spool to slide to the left. Due to this movement, the second land 307A opens supply port 313A, allowing pressurized fluid from the main supply passageway 116A to flow through the sleeve to the supply passageway 126A to the first load line 26 and into the first actuator chamber 204 causing the piston to extend. The pressurized fluid in the supply passageway 126A also enters the bypass passageway 134A. After passing through the filter 140A and the damping orifice 138A, the pressurized fluid flows into the first bore 30A between the threaded nut 142A and the second end 30*a* of the first spool, eventually creating a sufficient force on the second end of the spool to counteract the force on the first end of the spool so as to move the spool to the right and close off the supply port 313A. Because the A-side and B-side spool/sleeve assemblies are identical, the B-side spool/sleeve assembly will operate in substantially the same manner as the A-side.

Notably, at null (i.e., no signal to the torque motor), both spool/sleeve assemblies are servo-controlled to the receiver chamber pressure. Thus, if the pressure in the first actuator chamber is reduced, the force on the second end of the spool will not be sufficient to counter balance the force on the first end of the spool caused by receiver chamber pressurization, whereupon the spool will again move to the left, opening the supply port and again increasing the pressure in the first actuator chamber. Alternatively, if the pressure in the first actuator chamber is increased, the force on the second end of the spool will overcome the force on the first end of the spool, whereupon the spool will move to the right, opening the return ports and decreasing the pressure in the first actuator chamber. Furthermore, at null, the edges of the spool lands are substantially aligned with the edges of the supply ports 313A, B and the edges of the return ports 315A, B, 317A, B (see FIG. 1). This permits the respective spools to react immediately to the force created by the jet pipe pressurization, which is especially important during crossover for providing a smooth transition. In contrast, without receiver chamber pressurization, the spools will not necessarily be located in this ready position.

When a positive control signal is applied to the torque motor assembly (see FIGS. 2 and 4A), the jet-pipe will move counterclockwise so as to direct the stream of pressurized fluid into the first orifice 56 of the receiver module 48. As the input signal increases, the pressure in the passageway 124A will increase due to the increasingly direct line of action of the stream of pressurized fluid into the first orifice 56. The increased pressurization in the passageway 124A will increase the force applied by spool portion 86A to the first end 302A of the first spool 78, causing the pressure in the first actuator chamber to be servo-controlled to the new pressure level, as determined by the control signal.

As the actuator piston 202 moves to the left, fluid is expelled from the second actuator chamber 206 through the second load line 28 and through valve port 24. From there, the expelled fluid flows through the bypass passageway 134B passing through the filter 140B and the damping orifice 138B into the second bore 30B between the threaded nut 142B and the second end 304B of the second spool 80. The expelled fluid creates a sufficient force on the second end of the second spool to cause it to overcome the receiver chamber pressure acting on the first end of the spool, moving the second spool to the right. Due to this movement, the second land 307B and the third land 308B open return ports 315B and 317B, respectively, allowing expelled fluid to flow through the sleeve to the return passageways 118B and 130B, respectively. The force of the spool spring 92B may be set to apply a force to the second end of the second spool 80 to ensure that the return ports 315B and 317B remain open when pressurized fluid is not being supplied to the first end of this spool.

When a negative control signal is applied to the torque motor assembly (see FIGS. 2 and 4B), the jet-pipe will move clockwise so as to direct a stream of pressurized fluid into the second orifice 58 of the receiver module 48. The B-side spool/sleeve assembly will then permit pressurized fluid to flow to the second actuator chamber causing the piston to retract and the A-side spool/sleeve assembly will permit fluid expelled from the first actuator chamber to flow to return. It should be apparent that fluid flow in the B-side spool/sleeve assembly in FIG. 4B is identical to fluid flow in the A-side spool/sleeve assembly in FIG. 4A and fluid flow in the A-side spool/sleeve assembly in FIG. 4B is identical to fluid flow in the B-side spool/sleeve assembly in FIG. 4A.

The above-described pressure control valve also has a number of failsafe characteristics. For example, when the torque motor assembly coils are connected in parallel and driven from a current source, if one of the coils fails by open circuit, the system will operate normally with no change in accuracy or system stability. However, the voltage across the remaining operating coil will double for any given current, but the electronic drive circuits could detect this failure mode. If the coil short circuits or if there is a loss of signal to the valve, the valve will go to a null position and the receiver chamber will remain pressurized due to the pressure relief valve in the drain passageway. Hydraulic locking of the actuator, however, will not occur when the actuator is moved by adjacent actuators mechanically connected to the same structure. If the jet-pipe becomes contaminated, e.g., by plugging of the filter or jet nozzle, the receiver chamber will not remain pressurized. The spool springs will open the return lines and actuator chamber pressure will reduce to return pressure preventing hydraulic lock-up or hard-over of the actuator. If there is an actuator system failure, the electronic controller, if capable, can be used to lock the input current on all the actuators, then by reducing pilot supply pressure slowly to zero, all actuators will reduce loads on the test specimen in a controlled manner. If there is a computer hard-over signal, the load limiting valves will open and limit the maximum load force on the test specimen. If there is a loss of pilot supply pressure, all actuator loads will be reduced to zero in a controlled manner. If there is a loss of main supply pressure, however, accumulators will be needed to maintain system pressure during controlled shut-down of the structural test program. If there is a pressure transducer failure, the valve can operate open loop, but with a wider hysteresis and a degraded linearity. In the case of valve spool sticking, the load limiting valves will relieve to drain. In addition, the design of the spool creates large spool driving forces to adequately shear chips that are in the fluid.

It should be appreciated from the foregoing description that the present invention provides a pressure control valve that uses an input control current to control actuator forces in a substantially linear, straight-line relationship. The input current to the torque motor assembly directs pilot supply pressure through a receiver module to one of two passageways, which actuates a respective cartridge and spool/sleeve assembly. Reversing the input current to the torque motor assembly directs pilot supply pressure to the other of the two passageways, thus actuating the other cartridge and spool/sleeve assembly. Using one torque motor assembly to drive two independent spool/sleeve assemblies ensures that only one spool will be actuated by jet pipe pressurization at a time, preventing any substantial slack side pressurization. Additionally, a pressure relief valve may be placed in the pilot return line to maintain a predetermined pressure in the receiver chamber, thus insuring that both chambers of the actuator will be servo-controlled at all times during operation of the valve. The pressure control valve of the present invention may also be used with rotary hydraulic actuators or hydraulic motors for torque control.

Although the present invention has been described in detail with reference only to the presently preferred embodiment, it will be appreciated by those of ordinary skill in the art that various modifications can be made without departing from the invention. Accordingly, the invention is limited only by the claims set forth below and equivalents thereof.

We claim:

1. A two stage valve assembly responsive to signals from a control system for operating an actuator to be connected to a structural part, the actuator having first and second actuator chambers for moving the structural part in opposite directions by supplying pressurized fluid to one or the other of the chambers, respectively, the valve assembly to be connected to first and second load lines wherein the first load line is connected to the first actuator chamber and the second load line is connected to the second actuator chamber, the valve assembly to be supplied with pressurized fluid through a jet supply line and a main supply line, said valve assembly comprising:

a first stage assembly, a second stage assembly and first and second passageways for fluidically connecting the first stage assembly to the second stage assembly, the first stage assembly including, a jet pipe that receives pressurized fluid from the jet supply line and has an orifice for directing a stream of pressurized fluid out of the jet pipe;

a receiver assembly having a first receiver port that communicates with the first passageway, a second receiver port that communicates with the second passageway and a bleedoff area disposed between and separating the receiver ports; and a motor responsive to the signals from the control system for selectively directing the stream of pressurized fluid toward the bleed off area and each of the receiver ports;

wherein said first and second receiver ports are sufficiently spaced apart such that the stream of pressurized fluid substantially impinges no more than one of the first and second receiver ports at a time when the stream is moved from one receiver port to the other;

the second stage assembly including, a first spool assembly that receives pressurized fluid issuing from the first passageway, the first spool assembly having a supply port for supplying pressurized fluid from the main supply line to the first load line, a return port for permitting fluid from the first load line to exit the first spool assembly and a first spool having first and second ends wherein pressurized fluid from the jet pipe is supplied to only one of the two ends; and a second spool assembly that receives pressurized fluid from the second passageway, the second spool assembly having a supply port for supplying pressurized fluid from the main supply line to the second load line, a return port for permitting fluid from the second load line to exit the second spool assembly and a second spool having first and second ends wherein pressurized fluid from the jet pipe is supplied to only one of the two ends;

wherein the first and second spools are movable within their respective spool assemblies such that when pressurized fluid from the first passageway is transmitted to the first spool assembly, the first spool is urged to move in such a manner as to open the supply port to the first load line and when pressurized fluid from the second passageway is transmitted to the second spool assembly, the second spool is urged to move in such a manner as to open the supply port to the second load line.

2. The two stage valve assembly of claim 1, wherein the first and second receiver ports are separated by a distance greater than the width of the stream of pressurized fluid out of the jet pipe.

3. The two stage valve assembly of claim 1, wherein the first and second receiver ports are not raised above the bleedoff area and the bleed off area is a surface disposed substantially normal to the issuing stream.

4. The two stage valve assembly of claim 1, wherein the bleedoff area is a slot between the first and second receiver ports.

5. The two stage valve assembly of claim 1, wherein the first and second receiver ports are disposed in posts on each side of the bleedoff area.

6. The two stage valve assembly of claim 1, wherein the stream of pressurized fluid out of the jet pipe is centered between the first and second receiver ports when no signal is applied to the motor.

7. The two stage valve assembly of claim 6, wherein the stream of pressurized fluid out of the jet pipe does not impinge either of the first and second receiver ports when no signal is applied to the motor.

8. The two stage valve assembly of claim 1, further comprising means for maintaining one of said first and second receiver ports pressurized at a predetermined level when the stream of pressurized fluid is impinging the other of said first and second receiver ports.

9. The two stage valve assembly of claim 1, further comprising a cartridge means for transmitting the force of the pressurized fluid from the first passageway to the first spool, urging the first spool to move in such a manner as to open the supply port to the first load line.

10. A two stage valve assembly responsive to signals from a control system for creating a pressure differential between a first load line and a second load line, the valve assembly being supplied with pressurized fluid through a jet supply line and a main supply line, said valve assembly comprising:

a first stage assembly, a second stage assembly and first and second passageways for fluidically connecting the first stage assembly to the second stage assembly, the first stage assembly including, a jet pipe that receives pressurized fluid from the jet supply line and has an orifice for directing a stream of pressurized fluid out of the jet pipe;

a receiver assembly having a first receiver port that communicates with the first passageway, a second receiver port that communicates with the second passageway and a bleedoff area disposed between and separating the receiver ports; and a motor responsive to the signals from the control system for selectively directing the stream of pressurized fluid toward the bleed off area and each of the receiver ports;

wherein said first and second receiver ports are sufficiently spaced apart such that the stream of pressurized fluid substantially impinges no more than one of the first and second receiver ports at a time;

the second stage assembly including, a first spool assembly that receives pressurized fluid from the first passageway including a first spool, the first spool assembly having a supply port for supplying pressurized fluid from the main supply line to the first load line and a return port for permitting fluid from the first load line to exit the first spool assembly; and a second spool assembly that receives pressurized fluid from the second passageway including a second spool, the second spool assembly having a supply port for supplying pressurized fluid from the main supply line to the second load line and a return port for permitting fluid from the second load line to exit the second spool assembly;

wherein the first and second spools are movable within their respective spool assemblies such that when pressurized fluid from the first passageway is transmitted to the first spool assembly, the first spool is urged to move in such a manner as to open the supply port to the first load line and when pressurized fluid from the second passageway is transmitted to the second spool assembly, the second spool is urged to move in such a manner as to open the supply port to the second load line; and maintaining means for pressurizing the first passageway at a first predetermined level when the stream of pressurized fluid out of the jet pipe does not impinge the first receiver port and for pressurizing the second passageway at said first predetermined level when the stream of pressurized fluid out of the jet pipe does not impinge the second receiver port.

11. The two stage valve assembly of claim 10, wherein the maintaining means includes a receiver chamber around the jet pipe orifice and the receiver ports for receiving pressurized fluid from the jet pipe, a drain passageway leading away from the receiver chamber and a pressure relief valve associated with the drain passageway for relieving the pressure in the drain passageway when it exceeds the first predetermined level.

12. The two stage valve assembly of claim 10, wherein the first and second spool assemblies each include an auxiliary return port such that fluid from the first load line is permitted to flow simultaneously out of the return port and the auxiliary return port of the first spool assembly and fluid from the second load line is permitted to flow simultaneously out of the return port and the auxiliary return port of the second spool assembly.

13. The two stage valve assembly of claim 10, further comprising a first spool control means for moving the first spool in such a manner as to open the return port whenever the pressure in the first passageway drops below a second predetermined level and a second spool control means for moving the second spool in such a manner as to open the return port whenever the pressure in the second passageway drops below the second predetermined level, said second predetermined level set at a lower pressure than said first predetermined level.

14. The valve assembly of claim 10, further comprising a first pressure transducer to measure pressure in the first passageway and a second pressure transducer to measure pressure in the second passageway.

15. A two stage valve assembly responsive to signals from a control system for creating a pressure differential between a first load line and a second load line, the valve assembly being supplied with pressurized fluid through a jet supply line and a main supply line, said valve assembly comprising:

a first stage assembly, a second stage assembly and first and second passageways for fluidically connecting the first stage assembly to the second stage assembly, the first stage assembly including, a jet pipe that receives pressurized fluid from the jet supply line and has an orifice for directing a stream of pressurized fluid out of the jet pipe;

a receiver assembly having a first receiver port that communicates with the first passageway, a second receiver port that communicates with the second passageway and a bleedoff area disposed between and separating the receiver ports; and a motor responsive to the signals from the control system for selectively directing the stream of pressurized fluid toward the bleed off area and each of the receiver ports;

wherein said first and second receiver ports are sufficiently spaced apart such that the stream of pressurized fluid substantially impinges no more than one of the first and second receiver ports at a time;

the second stage assembly including, a first spool assembly that receives pressurized fluid from the first passageway including a first spool, the first spool assembly having a supply port for supplying pressurized fluid from the main supply line to the first load line and a return port for permitting fluid from the first load line to exit the first spool assembly; and a second spool assembly that receives pressurized fluid from the second passageway including a second spool, the second spool assembly having a supply port for supplying pressurized fluid from the main supply line to the second load line and a return port for permitting fluid from the second load line to exit the second spool assembly;

wherein the first and second spools are movable within their respective spool assemblies such that when pressurized fluid from the first passageway is transmitted to the first spool assembly, the first spool is urged to move in such a manner as to open the supply port to the first load line and when pressurized fluid from the second passageway is transmitted to the second spool assembly, the second spool is urged to move in such a manner as to open the supply port to the second load line; and a first cartridge means for transmitting the force of the pressurized fluid from the first passageway to the first spool, urging the first spool to move in such a manner as to open the supply port to the first load line.

16. The two stage valve assembly of claim 15, wherein the signal from the control system is an input current, and the first cartridge means is disposed adjacent the first spool and is sized such that the input current and the pressure in the first load line follow a substantially linear relationship as the first load line is pressurized from approximately 0 to 100 percent of the maximum pressure supplied by the main supply line.

17. The two stage valve assembly of claim 15, wherein said valve assembly is connected to an unequal area actuator having a movable piston, a piston rod connected to the piston, and first and second actuator chambers for moving the piston in opposite directions by supplying pressurized fluid to one of the chambers, said piston rod passing through the second actuator chamber, said first load line connected to the first actuator chamber and said second load line connected to the second actuator chamber, the first cartridge means being sized such that the relationship between the magnitude of the extend force of the actuator and the pressure in the first passageway is substantially the same as the relationship between the magnitude of the retract force of the actuator and the pressure in the second passageway.

18. The two stage valve assembly of claim 15, wherein said valve assembly is connected to an unequal area actuator having a movable piston and first and second actuator chambers for moving the piston in opposite directions by supplying pressurized fluid to one of the chambers, said first load line connected to the first actuator chamber and said second load line connected to the second actuator chamber, the first cartridge means being sized such that the relationship between the magnitude of the extend force of the actuator and the magnitude of a signal applied by the control system to the valve assembly is substantially the same as the relationship between the magnitude of the retract force of the actuator and the magnitude of a signal applied by the control system to the valve assembly.

19. The two stage valve assembly of claim 15, further comprising a second cartridge means for transmitting the force of the pressurized fluid from the second passageway to the second spool, urging the second spool to move in such a manner as to open the supply port to the second load line.

20. The two stage valve assembly of claim 19, wherein said valve assembly is connected to an unequal area actuator having a movable piston and first and second actuator chambers for moving the piston in opposite directions by supplying pressurized fluid to one of said chambers, said first load line connected to the first actuator chamber and said second load line connected to the second actuator chamber, at least one of said cartridge means being sized to create a substantially linear relationship between the signal from the control system and the output force of the actuator.

21. A two stage valve assembly responsive to signals from a control system for creating a pressure differential between a first load line and a second load line, the valve assembly being supplied with pressurized fluid through a jet supply line and a main supply line, said valve assembly comprising:

a first stage assembly, a second stage assembly and first and second passageways for fluidically connecting the first stage assembly to the second stage assembly, the first stage assembly including, a jet pipe that receives pressurized fluid from the jet supply line and has an orifice for directing a stream of pressurized fluid out of the jet pipe;

a receiver assembly having a first receiver port that communicates with the first passageway, a second receiver port that communicates with the second passageway and a bleedoff area disposed between and separating the receiver ports; and a motor responsive to the signals from the control system for selectively directing the stream of pressurized fluid toward the bleed off area and each of the receiver ports;

wherein said first and second receiver ports are sufficiently spaced apart such that the stream of pressurized fluid substantially impinges no more than one of the first and second receiver ports at a time;

the second stage assembly including, a first spool assembly that receives pressurized fluid from the first passageway including a first spool, the first spool assembly having a supply port for supplying pressurized fluid from the main supply line to the first load line and a return port for permitting fluid from the first load line to exit the first spool assembly; and a second spool assembly that receives pressurized fluid from the second passageway including a second spool, the second spool assembly having a supply port for supplying pressurized fluid from the main supply line to the second load line and a return port for permitting fluid from the second load line to exit the second spool assembly;

wherein the first and second spools are movable within their respective spool assemblies such that when pressurized fluid from the first passageway is transmitted to the first spool assembly, the first spool is urged to move in such a manner as to open the supply port to the first load line and when pressurized fluid from the second passageway is transmitted to the second spool assembly, the second spool is urged to move in such a manner as to open the supply port to the second load line;

a first cartridge axially mounted relative to said first spool assembly and located between said first spool assembly and an outlet of the first passageway, said first cartridge having a sleeve portion and a spool portion within said sleeve portion, the spool portion axially slidable relative to said sleeve portion; and a second cartridge axially mounted relative to said second spool assembly and located between said second spool assembly and an outlet of the second passageway, said second cartridge having a sleeve portion and a spool portion within said sleeve portion, the spool portion axially slidable relative to said sleeve portion;

wherein the first and second spools are in contacting alignment with the first and second cartridges, respectively, such that when pressurized fluid from the receiver assembly is transmitted to the outlet of the first passageway, the first cartridge urges the first spool to move in such a manner as to open the supply port to the first load line and when pressurized fluid from the receiver assembly is transmitted to the outlet of the second passageway, the second cartridge urges the second spool to move in such a manner as to open the supply port.

22. The two stage valve assembly of claim 21, wherein the first cartridge is one of a plurality of interchangeable cartridges, the sleeves of said interchangeable cartridges having the same outer diameters and different inner diameters.

23. A two stage valve assembly responsive to signals from a control system for creating a pressure differential between a first load line and a second load line, the valve assembly being supplied with pressurized fluid through a jet supply line and a main supply line, said valve assembly comprising:

a first stage assembly, a second stage assembly and first and second passageways for fluidically connecting the first stage assembly to the second stage assembly, the first stage assembly including, a jet pipe that receives pressurized fluid from the jet supply line and has an orifice for directing a stream of pressurized fluid out of the jet pipe;

a receiver assembly having a first receiver port that communicates with the first passageway, a second receiver port that communicates with the second passageway and a bleedoff area disposed between and separating the receiver ports;

a motor responsive to the signals from the control system for selectively directing the stream of pressurized fluid toward the bleed off area and each of the receiver ports;

a receiver chamber around the jet pipe orifice and the receiver ports for receiving pressurized fluid from the jet pipe;

a drain passageway leading away from the receiver chamber; and a pressure relief valve associated with the drain passageway for relieving the pressure in the drain passageway when it exceeds the first predetermined level;

wherein said first and second receiver ports are sufficiently spaced apart such that the stream of pressurized fluid substantially impinges no more than one of the first and second receiver ports at a time;

the second stage assembly including, a first spool/sleeve assembly that receives pressurized fluid from the first passageway including a first spool and a first sleeve, the first sleeve having a supply port for supplying pressurized fluid from the main supply line to the first load line and a return port for permitting fluid from the first load line to exit the first spool/sleeve assembly; and a second spool/sleeve assembly that receives pressurized fluid from the second passageway including a second spool and a second sleeve, the second sleeve having a supply port for supplying pressurized fluid from the main supply line to the second load line and a return port for permitting fluid from the second load line to exit the second spool/sleeve assembly;

wherein the first and second spools are movable within their respective sleeves such that when pressurized fluid from the first passageway is transmitted to the first spool/sleeve assembly, the first spool is urged to move in such a manner as to open the supply port to the first load line and when pressurized fluid from the second passageway is transmitted to the second spool/sleeve assembly, the second spool is urged to move in such a manner as to open the supply port to the second load line;

said second stage assembly further including, a first cartridge axially mounted relative to said first spool/sleeve assembly and located between said first spool/sleeve assembly and an outlet of the first passageway, said first cartridge having a sleeve portion and a spool portion within said sleeve portion, the spool portion axially slidable relative to said sleeve portion; and a second cartridge axially mounted relative to said second spool/sleeve assembly and located between said second spool/sleeve assembly and an outlet of the second passageway, said second cartridge having a sleeve portion and a spool portion within said sleeve portion, the spool portion axially slidable relative to said sleeve portion;

wherein the first and second spools are in contacting alignment with the first and second cartridges, respectively, such that when pressurized fluid from the receiver assembly is transmitted to the outlet of the first passageway, the first cartridge urges the first spool to move in such a manner as to open the supply port to the first load line and when pressurized fluid from the receiver assembly is transmitted to the outlet of the second passageway, the second cartridge urges the second spool to move in such a manner as to open the supply port.

24. A system for applying force to a structural part as a function of time, comprising:

a control system that generates signals as a function of time;

a first source of pressurized fluid;

a main system supply line connected to the first source of pressurized fluid;

a second source of pressurized fluid;

a pilot supply line connected to the second source of pressurized fluid wherein the main system supply line and the jet supply line are isolated from one another;

first and second load lines;

an actuator having a movable piston, a piston rod connecting the movable piston to the structural part, and first and second actuator chambers for moving the movable piston in opposite directions by supplying pressurized fluid to the chambers, said first load line connected to the first actuator chamber and said second load line connected to the second actuator chamber;

a two stage valve assembly having a first stage assembly, a second stage assembly and first and second passageways for fluidically connecting the first stage assembly to the second stage assembly, the first stage assembly including, a jet pipe that receives pressurized fluid from the pilot supply line and has an orifice for directing a stream of pressurized fluid out of the jet pipe;

a receiver assembly having a first receiver port that communicates with the first passageway, a second receiver port that communicates with the second passageway and a bleedoff area disposed between and separating the receiver ports; and a motor responsive to the signals from the control system for selectively directing the stream of pressurized fluid toward the bleed off area and each of the receiver ports;

wherein said first and second receiver ports are sufficiently spaced apart such that the stream of pressurized fluid substantially impinges-no more than one of the first and second receiver ports at a time when the stream is moved from one receiver port to the other;

the second stage assembly including, a first spool assembly that receives pressurized fluid from the first passageway including a first spool, the first spool assembly having a supply port for supplying pressurized fluid from the main system supply line to the first load line and a return port for permitting fluid from the first load line to exit the first spool assembly; and a second spool assembly that receives pressurized fluid from the second passageway including a second spool, the second spool assembly having a supply port for supplying pressurized fluid from the main system supply line to the second load line and a return port for permitting fluid from the second load line to exit the second spool assembly;

wherein the first and second spools are movable within their respective spool assemblies such that when pressurized fluid from the first passageway is transmitted to the first spool assembly, the first spool is urged to move in such a manner as to open the supply port to the first load line and when pressurized fluid from the second passageway is transmitted to the second spool assembly, the second spool is urged to move in such a manner as to open the supply port to the second load line.

25. The system of claim 24, further comprising maintaining means for pressurizing the first receiver port at a first predetermined level when the stream of pressurized fluid out of the jet pipe does not impinge the first receiver port and for pressurizing the second receiver port at said first predetermined level when the stream of pressurized fluid out of the jet pipe does not impinge the second receiver port.

26. The system of claim 24, further comprising a cartridge means for transmitting the force of the pressurized fluid from the first passageway to the first spool, urging the first spool to move in such a manner as to open the supply port to the first load line.

27. An actuating system responsive to signals from a control system for selectively applying force to a structural part, the actuating system being supplied with pressurized fluid through a jet supply line and a main supply line, said actuating system comprising:

first and second load lines;

an actuator to be connected to the structural part, the actuator having first and second actuator chambers for moving the structural part in opposite directions by supplying pressurized fluid to one or the other of the chambers, respectively, said first load line connected to the first actuator chamber and said second load line connected to the second actuator chamber;

a first stage assembly, a second stage assembly and first and second passageways for fluidically connecting the first stage assembly to the second stage assembly, the first stage assembly including, a jet pipe that receives pressurized fluid from the jet supply line and has an orifice for directing a stream of pressurized fluid out of the jet pipe;

a receiver assembly having a first receiver port that communicates with the first passageway, a second receiver port that communicates with the second passageway and a bleedoff area disposed between and separating the receiver ports; and a motor responsive to the signals from the control system for selectively directing the stream of pressurized fluid toward the bleed off area and each of the receiver ports;

wherein said first and second receiver ports are sufficiently spaced apart such that the stream of pressurized fluid substantially impinges no more than one of the first and second receiver ports at a time when the stream is moved from one receiver port to the other;

the second stage assembly including, a first spool assembly that receives pressurized fluid from the first passageway including a first spool, the first spool assembly having a supply port for supplying pressurized fluid from the main supply line to the first load line and a return port for permitting fluid from the first load line to exit the first spool assembly; and a second spool assembly that receives pressurized fluid from the second passageway including a second spool, the second spool assembly having a supply port for supplying pressurized fluid from the main supply line to the second load line and a return port for permitting fluid from the second load line to exit the second spool assembly;

wherein the first and second spools are movable within their respective spool assemblies such that when pressurized fluid from the first passageway is transmitted to the first spool assembly, the first spool is urged to move in such a manner as to open the supply port to the first load line and when pressurized fluid from the second passageway is transmitted to the second spool assembly, the second spool is urged to move in such a manner as to open the supply port to the second load line.

* * * * *